US006145283A

United States Patent [19]

Noordenbos et al.

[11] Patent Number: 6,145,283

[45] Date of Patent: Nov. 14, 2000

[54] APPARATUS FOR SANITARY PACKING OF USED OBJECTS

[75] Inventors: Gideon Noordenbos, Loenen a/d Vecht; Frederic A. Montijn, Delft, both of Netherlands

[73] Assignee: CWS International AG, Baar, Switzerland

[21] Appl. No.: 09/477,328

[22] Filed: Jan. 4, 2000

Related U.S. Application Data

[63] Continuation of application No. PCT/NL98/00384, Jul. 4, 1998.

[51] Int. Cl.[7] ..... B65B 9/20

[52] U.S. Cl. ..... 53/554; 53/375.4; 53/375.6; 53/390

[58] Field of Search ..... 53/553, 554, 555, 53/528, 374.3, 374.9, 375.6, 375.4, 390

[56] References Cited

U.S. PATENT DOCUMENTS

| | | | |
|---|---|---|---|
| 2,541,387 | 2/1951 | Salfisberg | 53/555 |
| 2,597,041 | 5/1952 | Stokes | 53/555 |
| 2,616,232 | 11/1952 | Meyer | 53/554 |
| 3,432,988 | 3/1969 | Minten | 53/554 |
| 3,846,569 | 11/1974 | Kaplan | 53/554 |
| 4,074,505 | 2/1978 | Keren | 53/450 |
| 4,376,365 | 3/1983 | Moertel | 53/555 |

FOREIGN PATENT DOCUMENTS

| | | | |
|---|---|---|---|
| WO 99/01343 | 1/1999 | WIPO | 53/553 |

*Primary Examiner*—John Sipos
*Attorney, Agent, or Firm*—Schweitzer Cornman Gross & Bondell LLP

[57] ABSTRACT

An apparatus for air and liquid-tight packing of objects for disposal, such as sanitary towels, disposable nappies, hypodermic needles and other hospital wastes comprises a pair of supply rolls of mutually adhesive foil strips. The side edge of the foil strips are urged towards each other to seal the respective side edges together while a transport system engages the side edges and moves the foil strips through the apparatus. A pressing system includes a pair of substantially flat elements, at least one of which is rotatable, which extend substantially over the width of the foil strips and guide the strips together capturing and sealing an object to be packed therebetween, and sealing the foil strips together across their width after passage of the object.

11 Claims, 2 Drawing Sheets

APPARATUS FOR SANITARY PACKING OF USED OBJECTS

This application is a continuation of Serial No. PCT/NL98/00384 filed Jul. 4, 1998.

BACKGROUND OF THE INVENTION

The invention relates to an apparatus for air and liquid-tight packing of objects for disposal such as sanitary towels, disposable nappies, hypodermic needles and other hospital waste.

Such waste, packed in small plastic bags or otherwise, is usually packed in larger plastic bags and added to the normally generated waste. This results in extra operations; the special containers usually used for this purpose must be emptied separately and added to the normally generated waste. There is moreover the danger of odour nuisance.

In order to obviate these drawbacks U.S. Pat. No. 4,074,505 provides an apparatus for the air and liquid-tight packing of objects, such as sanitary towels, disposable nappies, hypodermic needles and other hospital waste, for disposal. The apparatus includes two supply rolls for mutually adhesive foil strips; attaching means for urging the side edges of the foil strips toward each other; transporting means engaging the foil strip for transporting both foil strips; and pivoting pressing means for urging the foil strips towards each other over substantially the entire width after insertion of an object, so that they mutually adhere.

The object for disposal is enclosed on all sides between the two foil strips, so that the hazard of leakage of odour nuisance is precluded.

This known apparatus is, however, structurally complicated, and depends on a complex series of rollers to accept and seal the objects in the foil strips.

BRIEF DESCRIPTION OF THE INVENTION

It is thus the object of the present invention to provide an apparatus for air and liquid-tight packaging of the aforementioned general type of a simple construction.

This object is achieved in that pressing means comprise a pair of substantially flat elements which extend over at least a considerable part of the width of the foil strips and at least one of which takes a rotatable form. The flaps may form a funnel into which the objects fall to be sealed, the foil strips travelling along the inner-facing faces of the flaps. The lower edges of the flaps form a sealing means for the foil, opening as required to accommodate the passage of the objects therebetween.

The invention limits the number of components whereby the cost of the apparatus is reduced and the operational reliability is increased.

BRIEF DESCRIPTION OF THE DRAWINGS

The present invention will be elucidated hereinbelow with reference to the annexed drawings, in which.

DETAILED DESCRIPTION OF THE INVENTION

Figure 1:
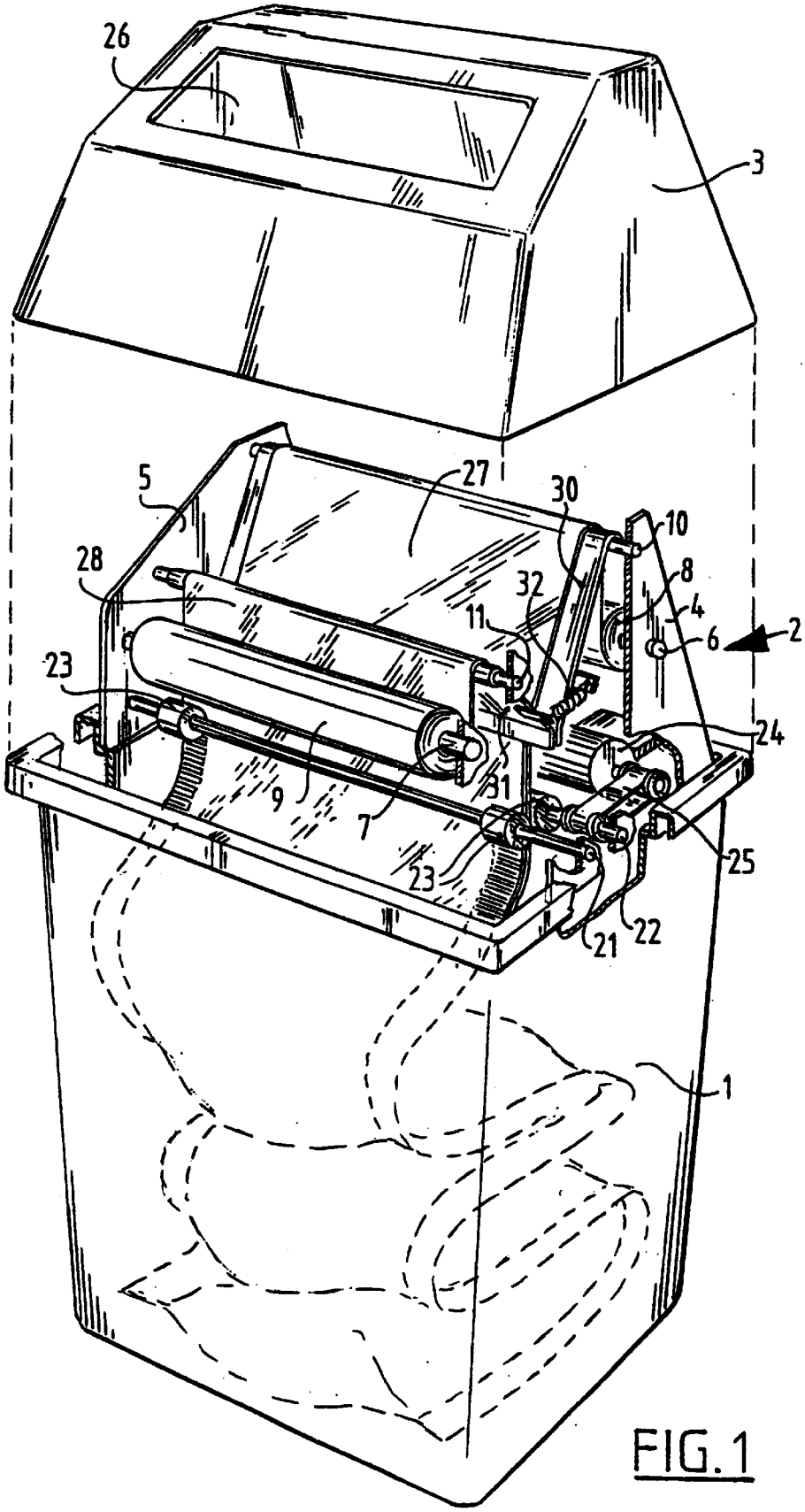
FIG. 1 shows a partly broken-away, perspective view of a first embodiment of an apparatus according to the invention.

The apparatus shown in FIG. 1 comprises a receiving container 1, above which the actual mechanism 2 is placed.

Mechanism 2 is closed off by a hood 3 placed on container 1. Mechanism 2 is formed by two plates 4,5 which are mutually connected by a number of shafts.

Arranged between plates 4 and 5 are two connecting rods 6, 7, on each of which is arranged a supply roll 8, 9 respectively of self-adhesive foil. Further arranged between the plates are two connecting rods 10, 11 respectively, upon each of which is placed a guide roller 12, 13 respectively.

Flaps 30, 31 are arranged on the connecting rods 10, 11. The flaps extend downward and can rotate relative to the rods. A spring 32 the urges flaps 30, 31 towards one another. The flaps 30, 31 each have a lower edge 34, 35 respectively where the flaps urge foil strips or sheets 27, 28, which are directed from their supply rolls between the flaps, towards one another.

Two shafts 21, 22 are further mounted rotatably between the two plates 4, 5. A pair of pressing rollers 23 is arranged on each of the shafts 21, 22. One of the shafts, i.e. 22, is drivable by means of an electric motor 24 and a belt connection 25. The motor 24 can include drive circuitry to process control signals as may be required for operation and shut-off. The drive circuitry can be responsive to variations in current draw for the motor to allow, for example, the determination of when the foil is depleted to allow an appropriate signal to be generated.

Finally, the apparatus is provided with a detection device (not shown in FIG. 1) which detects the insertion of an object in the opening 26 arranged in hood 3. The detection device is suitably connected to the drive circuitry.

The operation of the apparatus according to the invention is as follows:

When an object for packing is inserted in opening 26, it is detected by the detection device. The object falls between the foil strips 27, 28 unrolled from supply rolls 8, 9, and the electric motor 24 is switched on as a result of the detection, whereafter pressing rollers 23 are driven in rotation. The pressing rollers on the one hand cause the foil strips and the object captured and enclosed therebetween to move downward, while the foil strips are also pressed against each other at their side edges so that they mutually adhere. For this purpose either one or both of the foil strips can include a self-adhesive material surface or coating. It is also possible that for instance, the rollers 23 be provided with heating means to cause the foil strips to mutually adhere by means of fusing. It is also possible for a separate glue dispenser (not shown in the drawings) to be used for this purpose. The lower edges 34, 35 of the flaps 30, 31 under the mutual urging of spring 32 also effect a closure of the foil strips above the object. The edges continuously urge the foil strips 27, 28 toward one another but allow the packed object to pass therebetween.

When a heat adhesion sealing is used, it is possible for this purpose to heat the flap edges 34, 35 as well as the rollers 23. In such a case it is necessary to include a time switch or similar device to cause the heating to take place only when necessary and appropriate. When the electric motor 24, the operation of which is also pre-set by a time switch which may be part of the drive circuitry, has subsequently pulled the object for disposal to a position beneath rolls 15, 16, the motor 24 is switched off, the object being fully sealed in a packet formed by the adhered foil strips.

Figure 2:
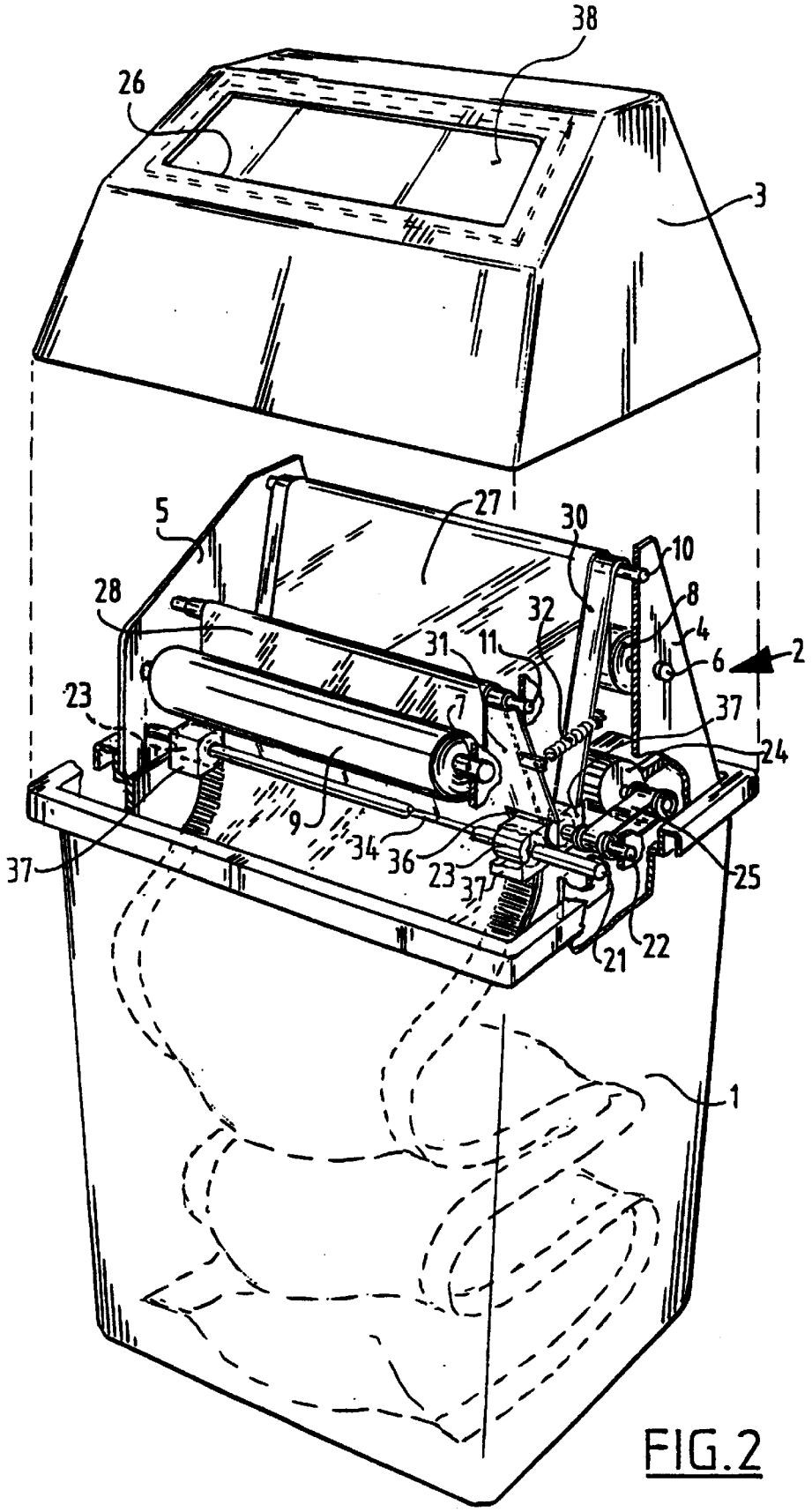
FIG. 2 shows a partly broken-away, perspective view of a second embodiment of the invention.

The embodiment shown in FIG. 2 differs slightly from the embodiment shown in FIG. 1 in the mutual positioning of the edges 34, 35 and shafts 21, 22 and the rollers 23 placed thereon. In the embodiment of FIG. 2 all of these elements are situated at the same height. This has the advantage that when rollers 23 are driven, whereby the foil strips are tensioned and pressed together, they cannot unintentionally spread the flaps 30, 31, since the tensile stress in the foil strips does not result in this configuration in a force component transversely of the flaps. Such a configuration does, however, have the consequence that the flaps 27, 28 must be provided with recesses 36 at the location of the rollers in order to provide space for the rollers.

This measure makes it desirable in turn for protective covers 37 to be arranged over the rollers 23. The covers protect the rollers and prevent fingers from being caught by the rollers 23. The protective covers are of course each provided with an appropriate recess at the position of engagement between the rollers and the foil strip.

Both the above described embodiments have two movable flaps. It is, however, also possible to fix one of the flaps. The construction becomes slightly simpler herewith and may allow for more freedom in the positioning of the funnel formed by the flap construction. It is thus possible for instance to tilt the funnel, whereby the apparatus can take a narrower form.

This may further provides more options for placing a closing flap 38 on the cover 3, as appears in FIG. 2, which can close off the insertion opening 26 when the foil runs out or when container 1 becomes full. A warning notice can be placed on the closing flap. The closing flap may also serve as the detection device for detection of the insertion of an object into the opening 26.

It is also to be pointed out that the apparatus can also be used in reverse manner, i.e. for unpacking products packed between two foil layers, for instance sterile packed products such as hypodermic needles, scalpels, dentist's tools. In such a case shafts 6, 7 must be driven in rotation instead of shafts 21 and 22, whereby the two foil sheets or strips are separated and rolled onto separate collection rolls.

The flaps 30, 31 must further be provided on their underside with a funnel for guiding the mutually adhered foil strips between the flaps without binding. Other guide means may also be necessary. Also, the foil strips must of course be mutually adhered such that they can be pulled apart. An operating button must further be arranged for activating the drive over a length such that a subsequent packed product is unpacked is exposed for removal.

A variety of foils may be used in connection with the invention. It is of course possible to use self-adhesive foils, as well as composites or non-adhesive foils, with a supply of glue during adhesion or with supply of heat during adhesion or separation as appropriate. It is also possible to make use of foils which are pulled toward each other by electrostatic or other means, such as by use of thick versions of known cling films.

The apparatus may be further provided with safety means to prevent body parts placed in the apparatus from being trapped and which prevent excessive use of foil.

A first such means relates to blocking or disconnection of the drive device when the flaps are not moved apart within a predetermined time after activation as a result of an object being transported between the flaps. Such means are to prevent an excessively large amount of foil being used as an object is placed in the infeed opening and remain there. The drive means incorporated with the motor can provide such a delay function in connection with a sensor, which for example can be incorporated with spring 32, to monitor the action of the flaps.

Another safety measure provides for repeated transport of the foil over short distances when, for instance, a large object is inserted which does not immediately clear the infeed opening after activation of the drive device. Repeated transport in short distance increments makes it possible, if a hand should be inserted, to still withdraw it. The incrementing can be repeated a number of times at a certain interval so that large objects can be moved inward. Once again, such operation can be incorporated into the motor drive circuitry, especially if the drive is under microprocessor control. It will be apparent that other safety measures can also be taken.

We claim:

1. Apparatus for air and liquid-tight packing of objects, comprising:

first and second supply rolls of mutually adhesive foil strips;

adhering means for urging side edges of the foil strips toward each other;

drive means engaging the foil strips for transporting both foil strips; and non-motorized pressing means for continuously urging the foil strips toward each other over substantially an entire width thereof after insertion of an object, for the mutual adherence of the strips, wherein the pressing means comprise a pair of substantially flat elements which extend over at least a substantial portion of the width of the foil strips and at least one of which pivots toward the other element, the flat elements forming an insertion funnel along an inner side of which the foil strips are guided and spring means connecting said flat elements to provide sole pressing force between said elements.

2. Apparatus as claimed in claim 1, wherein both elements are pivotable.

3. Apparatus as claimed in claim 1 or claim 2, wherein the drive means and the adhering means comprise a set of rollers which engage the sides of the foil strips and urge the side edges of the foil strips towards each other, and exert a downward directed force on the foil strips during driving.

4. Apparatus as claimed in claim 3, wherein the drive means further comprise an electric motor coupled to detection means for generating a motor activation signal when an insertion of an object into the apparatus is sensed.

5. Apparatus as claimed in claim 4, wherein the rollers of the adhering means are mounted pairwise on a shaft and a plane connecting the shafts is situated in the proximity of a bottom edge of the pressing means.

6. Apparatus as claimed in claim 5, wherein the plates are provided with recesses at to accommodate the rollers.

7. Apparatus as claimed in claim 6, wherein the rollers are provided protective covers.

8. Apparatus of claim 1, further comprising a detector for detecting exhaustion of the foil and for generating a signal in response to exhaustion of the foil.

9. Apparatus as claimed in claim 8, wherein the detector is adapted to carry a flap in front of an infeed opening leading to the insertion funnel.

10. Apparatus of claim 1, further comprising a control member for controlling the drive by periodic blocking of the drive means for increasing predetermined blocking periods.

11. Apparatus as claimed in claim 10, wherein the control member for controlling the drive means is adapted to block the drive means when the flaps remain together for a predetermined period after activation of the drive means.

* * * * *